United States Patent [19]

Matsui et al.

[11] 4,411,236

[45] Oct. 25, 1983

[54] AIR-FUEL RATIO CONTROL SYSTEM

[75] Inventors: Fujio Matsui, Musashino; Hitoshi Suzuki, Niiza, both of Japan

[73] Assignees: Fuji Jukogyo Kabushiki Kaisha, Tokyo; Nissan Motor Co., Ltd., Yokohama, both of Japan

[21] Appl. No.: 214,604

[22] Filed: Dec. 9, 1980

[30] Foreign Application Priority Data

Dec. 13, 1979 [JP] Japan ..... 54-162073

[51] Int. Cl.[3] ..... F02B 3/00; F02M 17/00

[52] U.S. Cl. ..... 123/492; 123/440

[58] Field of Search ..... 123/440, 492, 493, 489

[56] References Cited

U.S. PATENT DOCUMENTS

| | | | |
|---|---|---|---|
| 4,088,095 | 5/1978 | Aono | 123/440 |
| 4,119,072 | 10/1978 | Asano | 123/440 |
| 4,121,554 | 10/1978 | Sueishi | 123/440 |
| 4,153,022 | 5/1979 | Asano | 123/440 |
| 4,163,433 | 8/1979 | Fujishiro | 123/440 |
| 4,324,218 | 4/1982 | Hattori | 123/440 |

*Primary Examiner*—Ronald B. Cox

*Attorney, Agent, or Firm*—Martin A. Farber

[57] ABSTRACT

A system for controlling the air-fuel ratio for an internal combustion engine comprises an $O_2$ sensor for detecting the concentration of a constituent of exhaust gases passing through the exhaust passage, a carburetor for supplying air-fuel mixture to the induction passage of the engine, electromagnetic valves for correcting the air-fuel ratio of the air-fuel mixture supplied by the carburetor, a comparator for comparing the output signal of the $O_2$ sensor with reference to a reference value, an integrating circuit having a proportional circuit for integrating the output of the comparator, a driving circuit for driving the electromagnetic valve in dependency upon the output signal of the integrating circuit. The system further comprises a detecting device for detecting the acceleration of the engine, a switch for cutting out a part of the control operation of the integrating circuit, and a gate circuit responsive to outputs of the comparator and the detecting device for actuating the switch, whereby the control operation of the system is decreased under the condition of a lean air-fuel mixture supply and acceleration of the engine.

11 Claims, 11 Drawing Figures

AIR-FUEL RATIO CONTROL SYSTEM

BACKGROUND OF THE INVENTION

The present invention relates to a system for controlling the air-fuel ratio for an internal combustion engine emission control system having a three-way catalytic converter, and more particularly to a system for controlling the air-fuel ratio to a value approximating the stoichiometric air-fuel ratio so as to effectively operate the three-way catalyst.

Such a system is a feedback control system, in which an $O_2$ sensor is provided to sense the oxygen content of the exhaust gases to generate an electrical signal as an indication of the air-fuel ratio of the air-fuel mixture supplied by a carburetor. The control system comprises a comparator for comparing the output signal of the $O_2$ sensor with a reference value, an integrating circuit having a proportional circuit connected to the comparator, a driving circuit for producing square wave pulses from the output signal of the integrating circuit, and an on-off type electromagnetic valve for correcting the air-fuel ratio of the mixture. The control system operates to determine whether the feedback signal from the $O_2$ sensor is higher or lower than a predetermined reference value corresponding to the stoichiometric air-fuel ratio for producing an error signal for actuating the on-off electromagnetic valve to thereby control the air-fuel ratio of the mixture.

In the internal combustion engine, the air-fuel ratio of the air-fuel mixture inherently varies due to the delay of the supply of air and fuel. Describing the variation of the air-fuel ratio in detail with reference to the drawings, FIG. 5(a) shows an opening degree of the throttle valve of the engine. If the throttle valve is rapidly opened as shown in the figure, the amount of induced air increases with the increase of the opening degree as shown in (b). However, the amount of air varies with delay $Z_1$ and $Z_2$, respectively. Further, the amount of fuel induced in the cylinders of the engine increases with the increase of the air, as shown in (c), with a delay $Z_3$ due to delay of the operation of the carburetor and for other reasons such as adhesion of the fuel to the wall of the induction passage of the engine. Because of such a delay of the supplying of fuel, the air-fuel mixture is diluted. FIG. 5(d) shows such a lean air-fuel ratio L, which further causes a rich air-fuel ratio R.

FIG. 6 shows variations of variables in the engine provided with the above described feedback system for controlling the air-fuel ratio. Although variation of the throttle valve opening (FIG. 6(e)) and the amount of air (f) is the same as (a) and (b) of FIG. 5, the fuel and the air-fuel ratio are controlled as shown by (g) and (h). However, a considerable air-fuel ratio deviation including lean and rich air-fuel ratio portions L′ and R′ is induced by overshooting of the feedback control overshoot for the lean air-fuel mixture.

Such a deviation of the air-fuel ratio also occurs during rapid deceleration of the engine.

SUMMARY OF THE INVENTION

The object of the present invention is to provide a system for controlling air-fuel ratio which can decrease the variation of the air-fuel ratio caused by the acceleration and deceleration of the engine operation, thereby performing effective operation of the three-way catalyst.

According to the present invention, there is provided a system for controlling the air-fuel ratio for an internal combustion engine having an induction passage, an exhaust passage, a throttle valve, first detecting means for detecting the concentration of a constituent of exhaust gases passing through said exhaust passage, air-fuel mixture supply means for supplying to the induction passage, electromagnetic valve means for correcting the air-fuel ratio of the air-fuel mixture supplied by said air-fuel mixture supply means, comparator means for comparing the output signal of said first detecting means with a reference value, integrating circuit means having a proportional circuit for integrating the output of said comparator means, driving circuit means for driving said electromagnetic valve means in dependency upon the output signal of said integrating circuit means, the improvement comprising: second detecting means for detecting the operation of said engine; a first switch for decreasing the control operation of the system; gate circuit means responsive to outputs of said comparator means and said second detecting means for actuating said first switch; and said gate circuit means comprises logic gate means responsive to the outputs of said comparator means and said second detecting means when lean air-fuel mixture is supplied during acceleration for actuating said first switch.

Other object and feature of the present invention will become apparent from the following description with reference to the accompanying drawings.

DETAILED DESCRIPTION OF THE PREFERRED EMBODIMENTS

Figure 1:
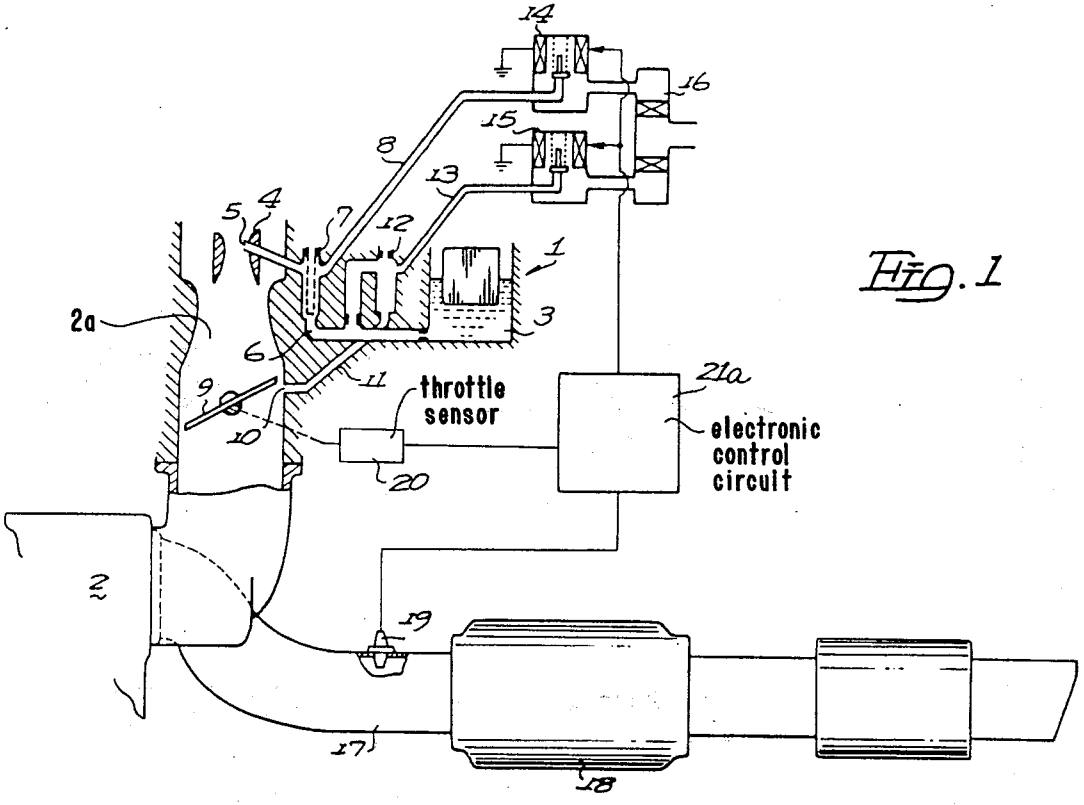
FIG. 1 is a schematic view of a system for controlling the air-fuel ratio according to the present invention.

Referring to FIG. 1, a carburetor 1 communicates induction passage 2*a* of an internal combustion engine 2. The carburetor comprises a float chamber 3, a venturi 4, a nozzle 5 communicating with the float chamber 3 through a main fuel passage 6, and a slow port 10 communicating with the float chamber 3 through a slow fuel passage 11. Air correcting passages 8 and 13 are provided in parallel to a main air bleed 7 and a slow air bleed 12, respectively. On-off type electromagnetic valves 14 and 15 are provided for the air correcting passages 8 and 13. An inlet port of each on-off electromagnetic valve communicates with the atmosphere through an air cleaner 16. An $O_2$ sensor 19 for detecting the oxygen content of the exhaust gases is provided on an exhaust pipe 17 upstream of a three-way catalytic converter 18.

A throttle sensor 20 is operatively connected to a throttle valve 9 in the induction passage 2a to detect the degree of opening of the throttle valve 9. Output signals of the sensors 19 and 20 are sent to an electronic control circuit 21a for actuating the on-off type electromagnetic valves 14 and 15 to control the air-fuel ratio of the mixture to a valve approximately to the stoichiometric air-fuel ratio.

Figure 2:
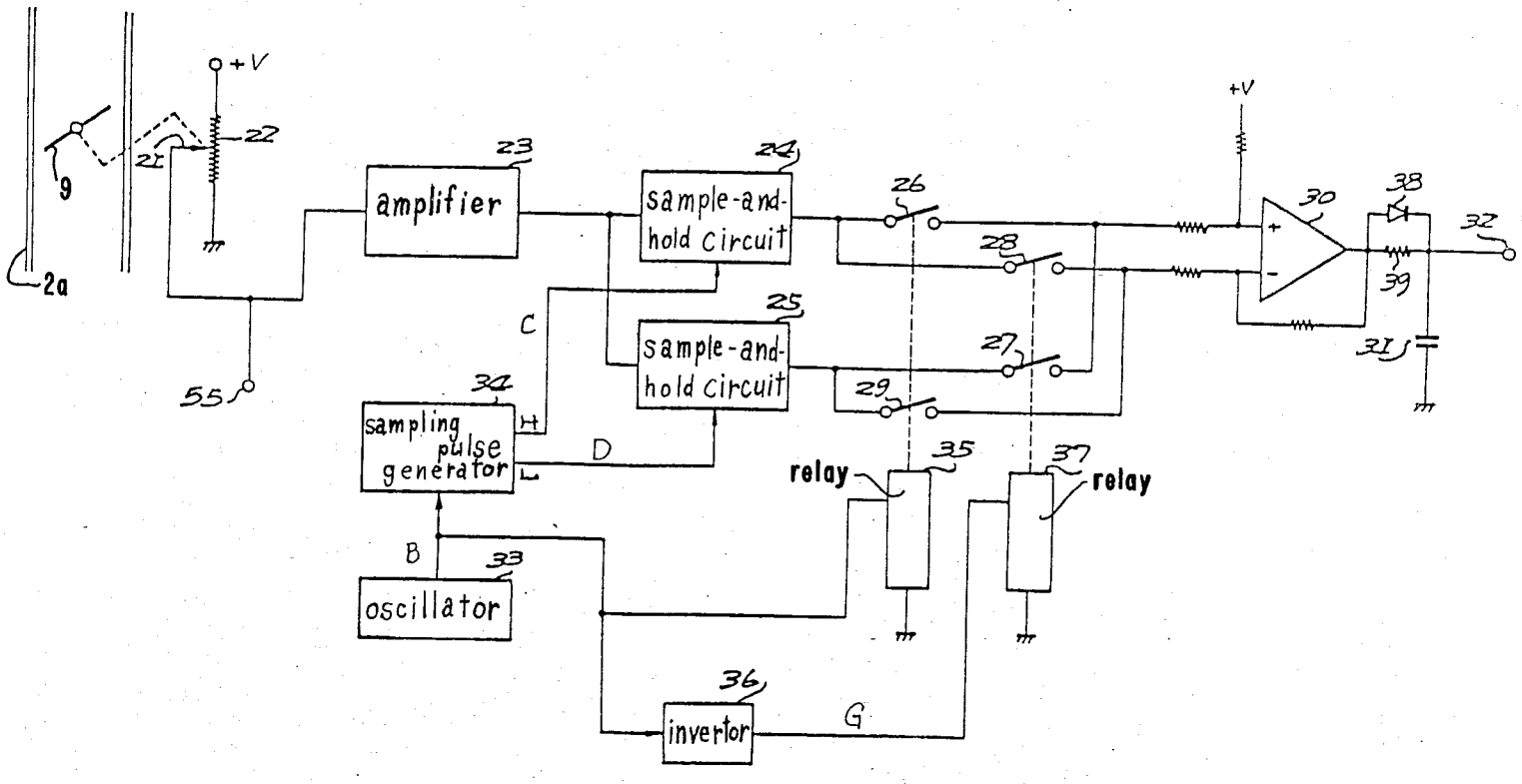
FIG. 2 is a block diagram of an electric circuit for detecting the operation of the throttle valve.

Referring to FIG. 2 showing an electric control system for the throttle sensor, the throttle valve 9 is connected to a sliding contact 21 of a potentiometer 22 which is applied with a voltage V. The voltage from the wiper 21 is applied to an output terminal 55 and to sample-and-hold circuits 24 and 25 via an amplifier 23. Each of the sample-and-hold circuits 24 and 25 comprises a holding capacitor and gates therefor as well known. The sample-and-hold circuit 24 is connected to the input terminals of an operational amplifier comparator 30 through relay contacts (switches) 26 and 28 respectively. The sample-and-hold circuit 25 is also connected to the input terminals of the operational amplifier comparator 30 through relay contacts (switches) 27 and 29.

On the other hand, an oscillator 33 is connected to a sampling pulse generator 34. The sampling pulse generator 34 operates to produce sampling pulses (C) of FIG. 4 and sampling pulses (D) which have a 180 degree phase difference relative to the pulses (C). The sampling pulses (D) and (C) are produced at the trailing and leading edges, respectively, of the pulses (B) from the oscillator 33. The sampling pulses (C) are fed to the sample-and-hold circuit 24 to actuate its gate and the pulses (D) are fed to the gate of the sample-and-hold circuit 25. The output of the oscillator 33 is also sent to a relay 35 and further to a relay 37 through an inverter 36. The relay 35 is adapted to actuate the relay contact 26 which connects the sample-and-hold circuit 24 to the non-inverting input of the comparator 30 and the relay contact 29 which connects the sample-and-hold circuit 25 to the inverting input of the comparator 30. The relay contacts 28 and 27 are connected with respect to the inputs of the comparator 30 in reverse relationship to the relay contacts 26 and 29. The relays 35 and 37 operate the switches 26, 29 and 28, 27 respectively.

Figure 4:
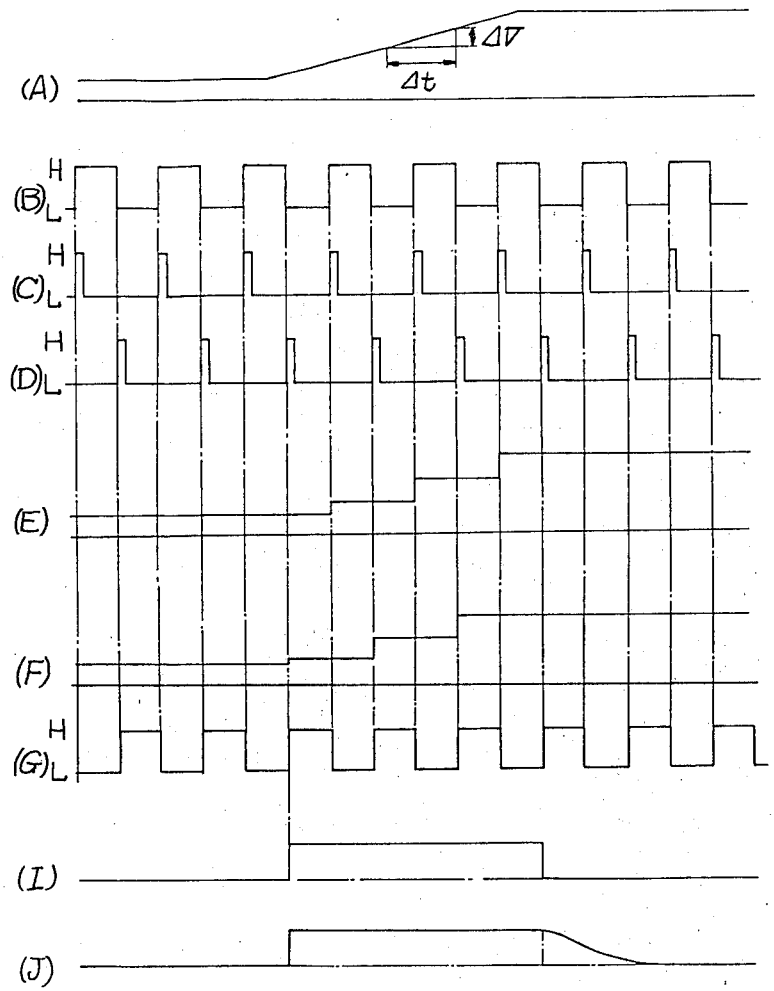
FIG. 4 shows wave forms in some portions in the circuit of FIG. 2.
Figure 5:
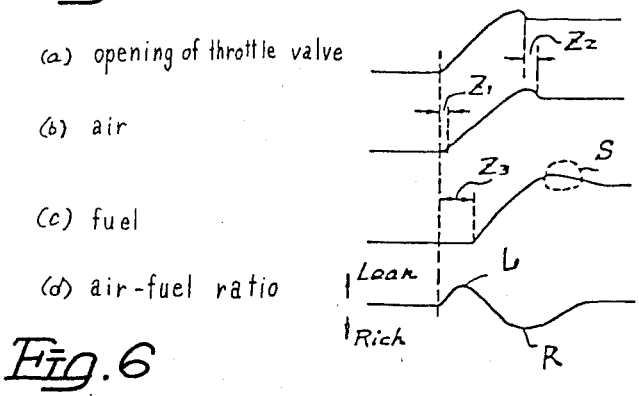
FIGS. 5 to 7 show wave forms for explaining relationship between the operation of the throttle valve and the air-fuel ratio.
Figure 6:
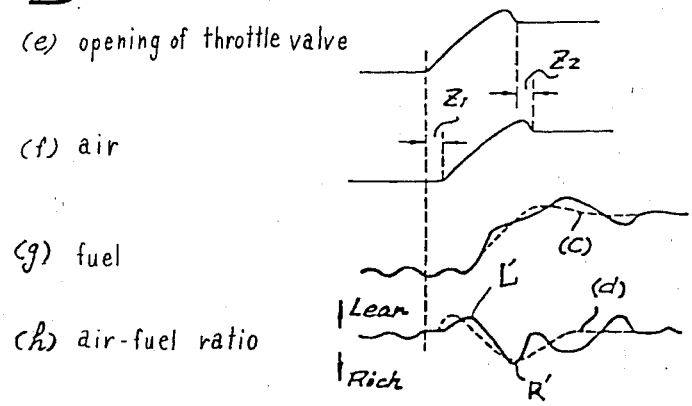

Referring to FIG. 4, curve (A) shows the voltage (A) detected by the potentiometer 22, which increases with an increase of the opening angle of the throttle valve 20. The sample-and-hold circuit 24 receives the voltage signal FIG. 4(A) from the potentiometer 22 via the amplifier 23 and the sampling pulses (C) from the pulse generator 34 to produce the output voltage (E), and the sample-and-hold circuit 25 is actuated by the voltage signal (A) from the potentiometer 22 via amplifier 23 and the sampling pulses (D) from the pulse generator 34 to produce the output voltage (F). More particularly as well known per se, when the gate of each sample-and-hold circuit is opened by the high level pulse "H" from the sample pulse generator 34, the voltage from the potentiometer 22 via the amplifier 23 is charged in the capacitor 24a, 25a in the respective sample-and-hold circuit 24, 25.

FIG. 4(G) shows the inverted wave form at the output of the inverter 36. The relay 35 is operated by the higher voltage "H" of the output pulses FIG. 4(B) of the oscillator 33 to close the relay contacts 26 and 29, and the relay 37 is operated by the higher voltage "H" of the output pulses (G) to close the relay contacts 28 and 27. Thus, the comparator 30 compares the voltages (E) and (F) alternately so that output voltage FIG. 4(I) is produced at the output of the comparator. The magnitude (that is the height) of the output voltage signal FIG. 4(I) is the voltage increment $\Delta V$ of the output voltage (A) with respect to time $\Delta t$ between successive pulses (C) and (D). Thus, the angular velocity of the throttle valve 9 may be represented by the output voltage FIG. 4(I). When the throttle valve stops or rotates in reverse, the output voltage of the comparator 30 disappears. Thus, the angular velocity and duration of the operation of the throttle valve may be quantitatively represented by the output voltage at an output terminal 32.

A grounded capacitor 31 is connected to a diode 38 which together with a resistor 39 are connected between the comparator 30 and the output terminal 32. The peak voltage is charged in the capacitor 31. When the throttle valve acceleration operation stops, the charged voltage on the capacitor 31 discharges through the resistor 39. The voltage reduces as shown in FIG. 4(J). If the output voltage from the output terminal 32 is differentiated by a differentiator (not shown), the angular acceleration of the throttle valve 9 can be represented.

Figure 3:
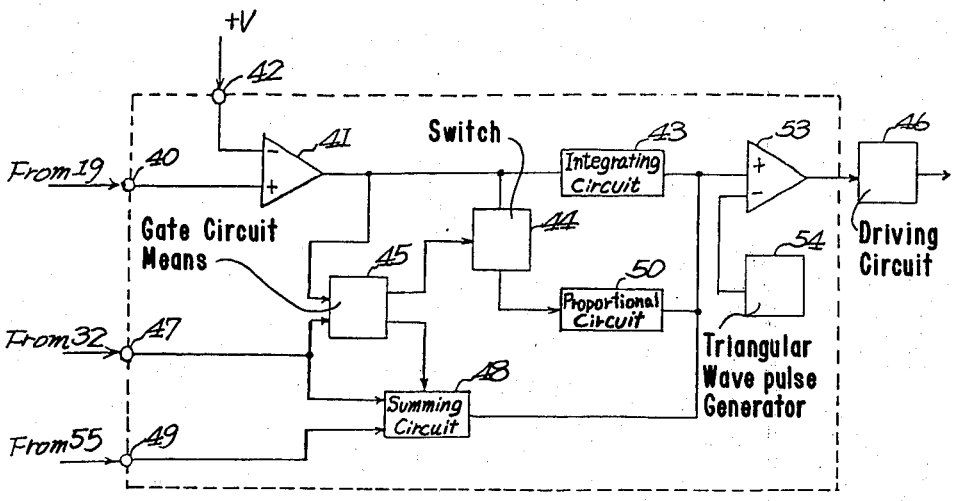
FIG. 3 shows a block diagram of an electronic control circuit according to the present invention.

A system of the present invention for controlling the air-fuel ratio is now described by reference to FIG. 3 showing an example of the air-fuel ratio control system.

The output signal of the $O_2$ sensor 19 is sent to a comparator 41 through a terminal 40. The comparator 41 operates to compare the input signal thereto with reference to a slice level applied from a terminal 42 to produce higher output or lower output than the slice level. The output is applied to an integrating circuit 43. A proportional circuit 50 is connected to the integrating circuit 43 as a feedback circuit. The output of the circuit 43 is compared in a comparator 53 with triangular wave pulses applied from a triangular wave pulse generator 54 for producing square pulses. The square pulses from the comparator 53 are fed to the on-off electromagnetic valves 14 and 15 through a driving circuit 46.

The output of the comparator 41 is fed to a gate circuit means 45 and the output of the circuit of FIG. 2 for detecting the throttle valve operation is also fed to the gate circuit means 45 and to a summing circuit 48 via a terminal 47. The output of the potentiometer 22 is fed to the summing circuit 48 via terminals 55 and 49. Control output signals of the gate circuit means 45 are fed to a control gate of a switch 44 provided in the circuit of the proportional circuit 50 and fed to the summing circuit 48. The output of the summing circuit 48 is fed to the comparator 53.

In operation, the output of the $O_2$ sensor 19 is fed to the comparator 41 for comparison with a set value corresponding to the stoichiometric air-fuel ratio. The output of the comparator 41 is fed to the comparator 53 through the integrating circuit 43. The comparator 53 produces output square wave pulses, the pulse width of which varies in dependency on the output of the integrating circuit 43 and the proportional circuit 50. Thus, the duty ratio of the electromagnetic valves 14 and 15 varies according to the output of the comparator 53 for controlling the air-fuel ratio of the mixture to the stoichiometric air-fuel ratio.

Figure 3A:
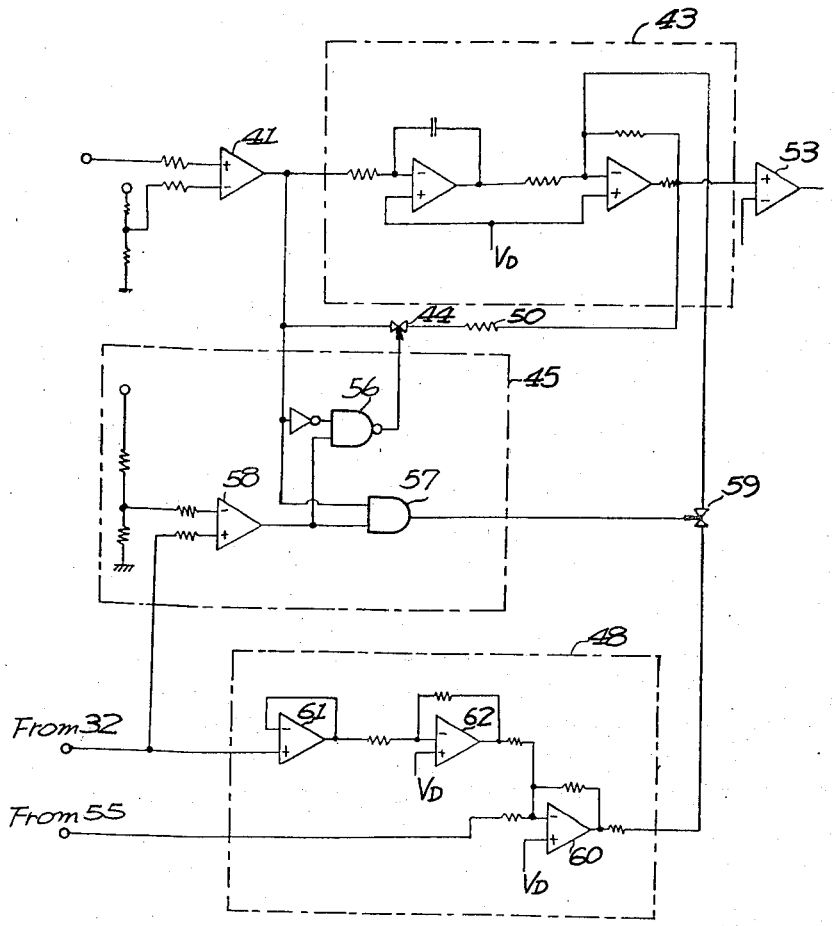
FIG. 3*a* is an example of the electronic control circuit of FIG. 3.

When the engine is rapidly accelerated, a lean air-fuel mixture is induced in the cylinders and an output is produced from the terminal 32 (FIG. 2) as described above. Because of such a lean air-fuel mixture, the output voltage of the $O_2$ sensor 19 decreases below the reference value of the comparator 41. Thus, the output of the comparator 41 goes to a low level. Referring to FIG. 3*a*, the low level output is sent to a NAND gate 56 and an AND gate 57 of the gate circuit means 45. On the other hand, a higher output signal such as FIG. 4(I) is produced at the terminal 32 (FIG. 2) by the rapid acceleration as described hereinbefore. The high level signal is also fed to the NAND gate 56 and the AND gate 57 through a comparator 58. Thus, the output of the NAND gate 56 changes to a low level, so that the switch 44 is opened by the low level signal. Accordingly, the control with the proportional circuit 50, namely a proportional component in the output of the integrating circuit 43 is cut out. Therefore, the feedback control operation of the control system is suppressed, so that overshooting of the control may be prevented. Such a suppression operation continues as long as lean air-fuel mixture is supplied ($t_1$ of FIG. 7) and the acceleration signal occurs. Thus, air-fuel ratio deviation due to rapid acceleration may be prevented.

When the output voltage of the $O_2$ sensor 19 increases to a high level by a rich air-fuel mixture or the input of the comparator 58 decreases to a low level, the output of the NAND gate 56 changes to a high level to close the switch 44. Thus, the normal feedback control including the proportional component operates to correct the air-fuel ratio.

Figure 7:
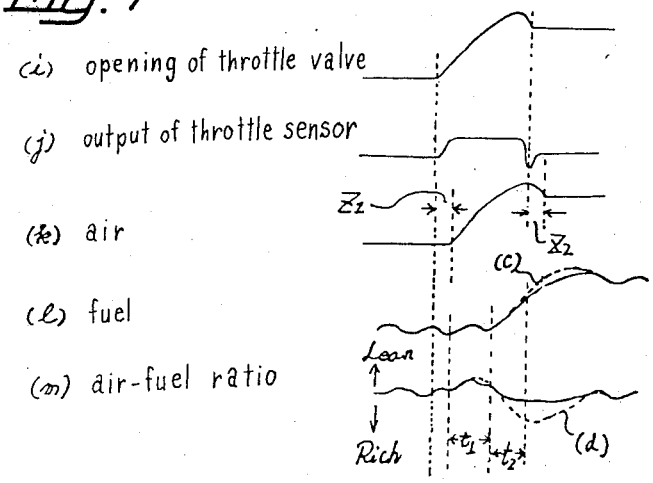

When the outputs of both comparators 41 and 58 are at a high level ($t_2$ of FIG. 7), the output of the NAND gate 57 goes to a high level to close a switch 59. On the other hand, the output at the terminal 32 is fed to an adder 60 through a buffer 61 and an inverter 62, and the output at the terminal 55 of the potentiometer 22 is also fed to the adder 60 so as to be added with the signal from the terminal 32. By closing the switch 59, the output of the adder 60, which is dependent on the operation of the throttle valve, is also fed to the comparator 53 for adjusting the feedback control. Thus, the air-fuel ratio can converge to stoichiometry as shown in FIG. 7(m). FIG. 4(j) shows the output at the terminal 32.

Figure 8:
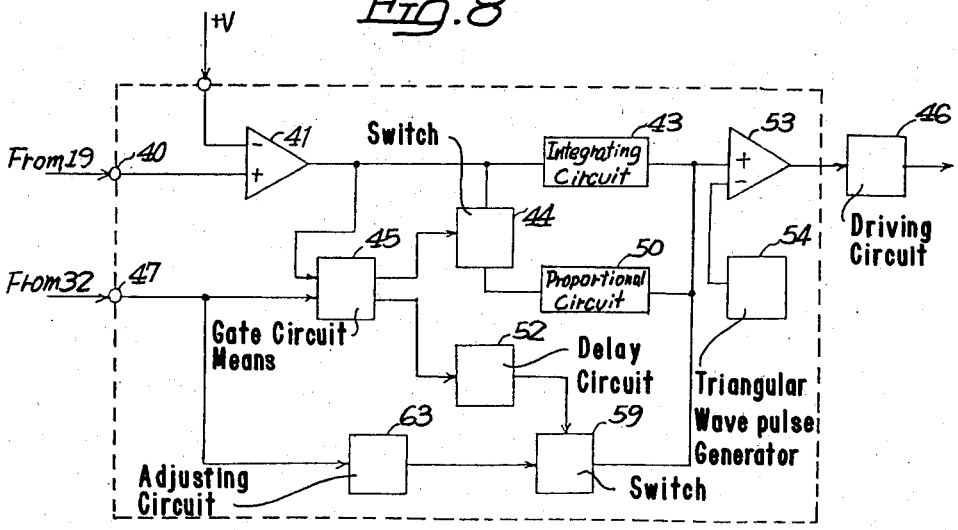
FIG. 8 shows another embodiment of the present invention.
Figure 8A:
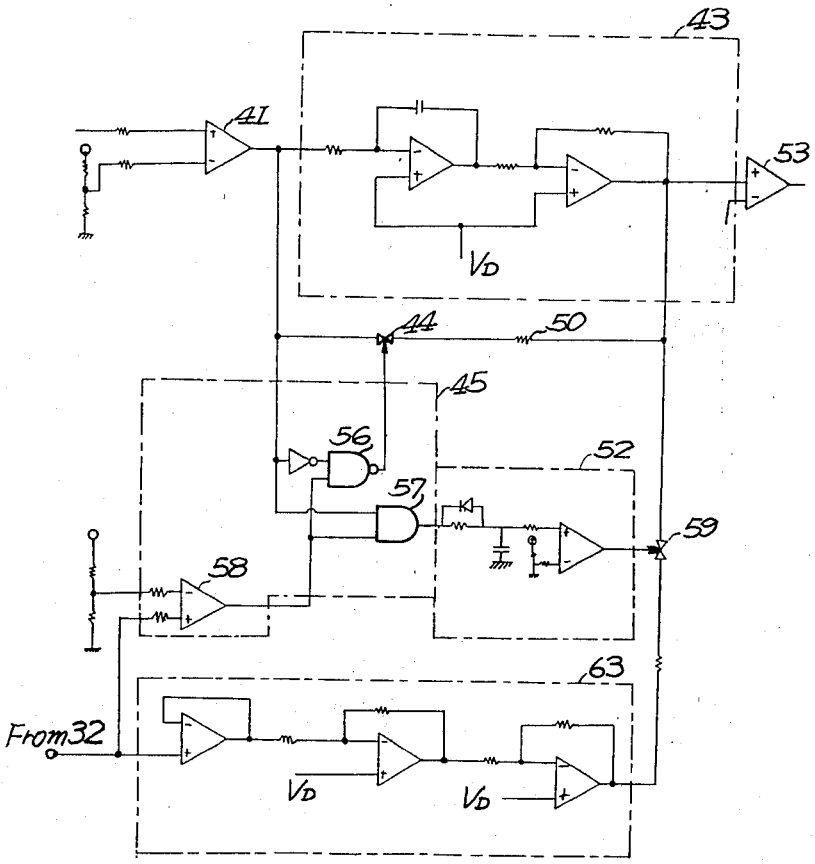
FIG. 8*a* is an example of the circuit of FIG. 8.

Referring to FIGS. 8 and 8*a* showing another embodiment of the present invention, the system is not provided with the adder for summing the outputs at terminals 32 and 55 as in the previous embodiment. The output at the terminal 32 is fed to the comparator through an adjusting circuit 63 and the switch 59. The output of the AND gate 57 is fed to the switch 59 through a delay circuit 52. Thus, when the switch 59 is closed, the adjusted output of the throttle acceleration operation is fed to the comparator 53 for controlling the air-fuel ratio.

Figure 9:
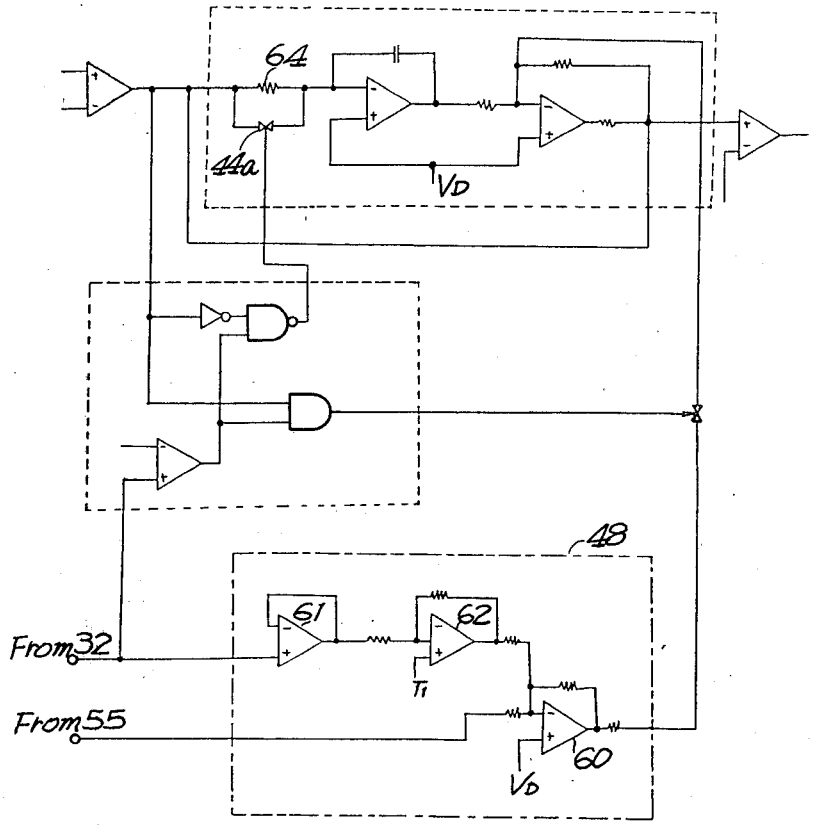
FIG. 9 shows a further embodiment of the present invention.

FIG. 9 shows a further embodiment in which the switch 44*a* corresponding to the switch 44 of FIG. 3 is provided in the short circuit for a resitor 64. Other portions are the same as FIG. 3. Thus, in this system, the integrating circuit control is suppressed by closing the switch 44*a*.

Although a throttle sensor is provided in the illustrated embodiments for detecting the engine operation, another sensor such as a vacuum sensor for detecting the vacuum in the induction passage or in the venturi may be employed.

What is claimed is:

1. In a system for controlling an air-fuel ratio for an internal combustion engine having an induction passage, an exhaust passage, a throttle valve, first detecting means for detecting a concentration of a constituent of exhaust gases passing through said exhaust passage, means for supplying air-fuel mixture to the induction passage, electromagnetic valve means for correcting the air-fuel ratio of the air-fuel mixture supplied by said air-fuel mixture supply means, comparator means for comparing the output signal of said first detecting means with a reference value, integrating circuit means including a proportional circuit for integrating the output of said comparator means, driving circuit means for driving said electromagnetic valve means in dependency upon the output signal of said integrating circuit means, the improvement of the system comprising:

second detecting means for detecting the operation of said engine;

a first switch means for decreasing the control operation of the system;

gate circuit means responsive to the outputs of said comparator means and said second detecting means for actuating said first switch means;

said gate circuit means comprising logic gate means responsive to the output of said comparator means when lean air-fuel mixture is supplied and to the output of said second detecting means at the acceleration of the engine for actuating said first switching means.

2. In a system for controlling an air-fuel ratio for an internal combustion engine having an induction passage, an exhaust passage, a throttle valve, first detecting means for detecting a concentration of a constituent of exhaust gases passing through said exhaust passage, means for supplying air-fuel mixture to the induction passage, electromagnetic valve means for correcting the air-fuel ratio of the air-fuel mixture supplied by said air-fuel mixture supply means, comparator means for comparing the output signal of said first detecting means with a reference value, integrating circuit means including a proportional circuit for integrating the output of said comparator means, driving circuit means for driving said electromagnetic valve means in dependency upon the output signal of said integrating circuit means, the improvement of the system comprising second detecting means for detecting an acceleration and deceleration condition of said engine;

a first switch means for suppressing operation of said integrating circuit means;

gate circuit means responsive to the outputs of said comparator means and said second detecting means for actuating said first switch means; and said gate circuit means comprising logic gate means responsive to the outputs of said comparator means and said second detecting means at lean air-fuel mixture supply in acceleration conditions of the throttle valve for operating said first switch means so as to suppress the operation of said integrating circuit means.

3. A system for controlling the air-fuel ratio for an internal combustion engine according to claim 2 wherein said second detecting means is a sensor for detecting the acceleration and deceleration of the engine.

4. A system for controlling the air-fuel ratio for an internal combustion engine according to claim 3 wherein said sensor includes first circuit means for producing its output in dependency on the angular velocity of said throttle valve.

5. A system for controlling the air-fuel ratio for an internal combustion engine according to claim 2 wherein said first switch means is provided in said proportional circuit for cutting out the operation thereof.

6. A system for controlling the air-fuel ratio for an internal combustion engine according to claim 2 wherein said first switch means is provided in said integrating circuit for decreasing the operation thereof.

7. In a system for controlling an air-fuel ratio for an internal combustion engine having an induction passage, an exhaust passage, a throttle valve, first detecting means for detecting a concentration of a constituent of exhaust gases passing through said exhaust passage, means for supplying air-fuel mixture to the induction passage, electromagnetic valve means for correcting the air-fuel ratio of the air-fuel mixture supplied by said air-fuel mixture supply means, comparator means for comparing the output signal of said first detecting means with a reference value, integrating circuit means including a proportional circuit for integrating the output of said comparator means, driving circuit means for driving said electromagnetic valve means in dependency upon the output signal of said integrating circuit means, the improvement of the system comprising:

second detecting means for detecting the operation of said engine;

a first switch means for decreasing the control operation of the system;

gate circuit means responsive to the outputs of said comparator means and said second detecting means for actuating said first switch means;

said gate circuit means comprising logic gate means responsive to the output of said comparator means when lean air-fuel mixture is supplied and to the output of said second detecting means at the acceleration of the engine for actuating said first switch means, said second detecting means is a sensor for detecting the acceleration and deceleration of the engine, and said sensor includes first circuit means for producing an output in dependency on the angular velocity of said throttle valve.

8. A system for controlling the air-fuel ratio for an internal combustion engine according to claim 1 further comprising second circuit means for adding a signal dependent on the output of said second detecting means to the output of said integrating circuit means and a second switch means for connecting said second circuit means to the output of said integrating circuit means, said gate circuit means includes a gate means which operates under the condition of rich air-fuel mixture supply and acceleration of the engine for closing said second switch means.

9. A system for controlling the air-fuel ratio for an internal combustion engine according to claim 7 further comprising second circuit means for adding a signal dependent on the output of said second detecting means to the output of said integrating circuit means and a second switch means for connecting said second circuit means to the output of said integrating circuit means, said gate circuit means includes a gate means which operates under the condition of rich air-fuel mixture supply and acceleration of the engine for closing said second switch means.

10. A system for controlling the air-fuel ratio for an internal combustion engine according to claim 7 wherein said gate circuit means includes an adder means for adding the output of said first circuit means to the output of said second detecting means.

11. The system as set forth in claim 2, wherein said first switch means is for decreasing the control operation of the system.

* * * * *